United States Patent [19]

Popp et al.

[11] 4,180,457

[45] Dec. 25, 1979

[54] PROCESS FOR DESALTING AND DEHYDRATION OF CRUDE OIL INCLUDING HOT WATER WASHING AND GAS STRIPPING

[75] Inventors: Valer V. Popp; Ion Suditu; Petre Neagu, all of Cîmpina; Leonida Fotescu, Ploiesti; Ion Mihalache, Bucharest; Dumitru Tirboiu, Cîmpina, all of Romania

[73] Assignee: Trustul Petrolului Bolintin, Comuna Bolintin din Vale, Romania

[21] Appl. No.: 870,105

[22] Filed: Jan. 17, 1978

[51] Int. Cl.[2] ..... C10G 33/04; C10G 31/08

[52] U.S. Cl. ..... 208/188

[58] Field of Search ..... 208/187, 188

[56] References Cited

U.S. PATENT DOCUMENTS

| | | | |
|---|---|---|---|
| 2,446,040 | 7/1948 | Blair, Jr. | 208/188 |
| 2,785,120 | 3/1957 | Metcalf | 208/187 |
| 2,825,678 | 3/1958 | Jahnig et al. | 208/187 |
| 2,930,749 | 3/1960 | Davis | 208/187 |
| 3,001,604 | 9/1961 | Worley | 208/187 |
| 3,296,117 | 1/1967 | Ross et al. | 208/188 |
| 3,950,245 | 4/1976 | Aliev et al. | 208/187 |

*Primary Examiner*—George Crasanakis
*Attorney, Agent, or Firm*—Karl F. Ross

[57] ABSTRACT

Process and apparatus for the desalting and dehydration of crude oil wherein, the crude oil is washed in one or several stages using fresh or recirculated hot water containing a demulsifier. The crude oil is also passed through a coalescence stage, and a settling stage aimed at obtaining a salt content to meet crude oil specifications. Subsequently the crude oil is led into a lower stripping compartment of a column, in which dehydration is carried out to the desired level by using fuel or combustion gas, the stripping temperature being reached by heating the crude or the gas or both, the gas-vapor mixture being cooled in the upper compartment of the column by a cooling fluid such as the untreated crude oil or recirculated or fresh water, depending upon the nature and salt content of the crude. The cooled gas is recirculated within the column or led to a pipeline for consumption, while the cooling fluid, in the case of water, is recirculated in the unit.

2 Claims, 2 Drawing Figures

PROCESS FOR DESALTING AND DEHYDRATION OF CRUDE OIL INCLUDING HOT WATER WASHING AND GAS STRIPPING

FIELD OF THE INVENTION

The invention involves a process and apparatus for desalting and dehydrating crude oils obtained as water-oil emulsions during primary, secondary, tertiary recovery processes from hydrocarbon reservoirs.

BACKGROUND OF THE INVENTION

Methods are known for desalting and dehydrating crude oils having initial boiling temperatures above 150° C. to which a demulsifier, is added, followed by desalting by single stage washing. Then the crude oil containing about 20% water, is dehydrated by stripping with a hot gas at about 250° C. The resulting crude oil is then used as a thermal agent in preheating the untreated crude oil; finally the desalted and dehydrated crude oil is led to storage.

These methods have several disadvantages they cannot be used for crudes having a high content of light fractions and salt; they require large amounts of demulsifier, which is removed together with the residual water; and the thermal energy consumption is relatively high.

The apparatus used for desalting and dehydration can comprise tanks in which washing, heating, settling and desalting of the crude occur in a single stage, heaters for gas heating, stripping columns, and pumps for circulating the crude and compressors for gas recirculation.

The disadvantage of such apparatus is that the tank volumes being relatively high, the thermal energy recovery efficiency is rather low.

SUMMARY OF THE INVENTION

The present invention relates to a process that eliminates the above disadvantages in that washing of the crude is carried out with demulsifier-containing hot water in several stages, depending upon the salt content of the crude, followed by the separation and removal of the free water, after which an optimum amount of demulsifier is added, the crude being heated and led to a treater with or without coalescence, depending upon the nature of the crude oil since the coalescence can also be obtained in interchangeable devices placed up stream of the treater. The hot water separated therein is circulated as the washing agent and the treated crude, still containing volatile fractions and/or water, may be heated, to a temperature lower, equal to or higher than the stripping temperature. Then the crude is directed to the upper part of the lower compartment of a column, wherein the crude contacts gas in countercurrent. This gas, which can be, is at a temperature higher, equal to or lower than the stripping temperature and carries away water vapor and volatile hydrocarbons, while the dehydrated crude is removed at the bottom of the column. The water vapor and the volatile hydrocarbons are carried by the gas to the upper compartment of the column, where they are condensed and cooled by direct contact with a cooling fluid such as water in the case of light crudes or untreated crude/water in the case of heavy crudes. Subsequently the crude is washed, while the cold gas is sent to the pipeline or is recirculated within the column.

The treating unit according to the invention eliminates the previous disadvantages in that it comprises two parts, one for the thermochemical treatment of the crude and one for stripping the crude in a stripping column. The heavy, cold crude coming from the wells is introduced at the top thereof where it contacts hot, damp gas, that upon contact with the crude becomes cold, resulting in the condensation of the water. The crude is removed from this compartment and after passing through a mixer, belonging to the thermochemical treating part, in which it contacts its own circulated water containing a demulsifier, the crude is led into a separator, the free water being removed therefrom. An optimum amount of demulsifier is next added to the crude. Subsequently the crude passes through a hot oil heat exchanger and through a heater, to be introduced into a tank which can be provided with a coalescence layer but need not be, since the coalescence can also be obtained in interchangeable devices mounted up stream of the tank. From this tank the crude, having a water content and salinity of which should meet the treated crude specifications, overflows into a buffer tank, while the separated hot water is led to a mixer together with the crude preheated in the upper compartment of the column. The crude from the buffer tank is conveyed through a heater, belonging to the stripping part, and introduced into the stripping compartment of the column through a foam breaker. The column compartments, provided with trays or filler, are super-imposed and separated by a thermally insulated wall penetrated by a covered tube extending into the upper compartment. This tube has lateral slots to permit gas circulation from the bottom to the top compartment and avoids at the same time contamination of the treated crude by the cooling fluid. In the lower stripping compartment the crude contacts in countercurrent the fuel gas or the combustion gas introduced into this compartment. As this gas becomes hot it carries the water in a vapor phase to the top compartment in which the water condenses. The gas removed from this compartment through a mist separator is directed to purifying means, whence the gas can be sent to a pipeline for consumption or can be recirculated through the column using a blower, while the crude coming from the lower stripping compartment passes through the heat exchanger and is introduced into a storage tank.

In another embodiment of the present invention the treating unit consists of a thermochemical part and a stripping part, the light crude oil having a high salt content is fed into the thermochemical part which comprises a mixer in which the crude contacts low salinity hot water containing a demulsifier, and a free-water separator, the water being removed therefrom to the outside. The crude is led to another mixer where it contacts hot fresh water, and further to another separator from which the free water is removed and the crude, after receiving an optimum amount of demulsifier is passed through a hot oil heat exchanger and through a heater, said crude is directed to a treater, with or without coalescence layer, as the coalescence can also be obtained in interchangeable devices mounted upstream of the treater. The hot water removed from the separator and heater is led to the first mixer into which the crude oil coming from the wells is fed, while the crude removed from the treater enters the stripping compartment across a foam breaker. In the stripping compartment the crude passes into countercurrent contact with the hot gas, the function of which is to carry away the water and volatile hydrocarbons as a vapor phase. This vapor phase condenses in the upper compartment of the column upon direct contact with fresh water, the compartments being separated so as to ensure gas circulation from one compartment to the other and to avoid contamination of the treated crude by the fresh water. The condensate of the upper compartment is removed in a separator, where the water is separated from the natural gasoline, the water being then partly led to a cooling tower and partly to a second mixer, where the crude is mixed with fresh, hot water, after said fresh water has first been passed through a heater. The water from the cooling tower is led to the upper compartment, and the natural gasoline from the separator is introduced into a tank, while the hot, dehydrated and stabilized crude is removed from the lower compartment and led to storage means after giving up part of the heat in the heat exchanger mounted downstream of the separator in which the optimum amount of demulsifier is being added to the crude. The stripping gas passes through a heater to be introduced into the lower stripping compartment of the column, being removed therefrom after it has passed through both compartments. The said gas is then directed to purifying means, wherefrom it may be recirculated within the column using a blower or it may be led to a pipeline for consumption or to the processing plant.

BRIEF DESCRIPTION OF THE DRAWING

Two specific examples of the invention are given below, in conjunction with the accompanying drawing showing.

SPECIFIC DESCRIPTION

Figure 1:
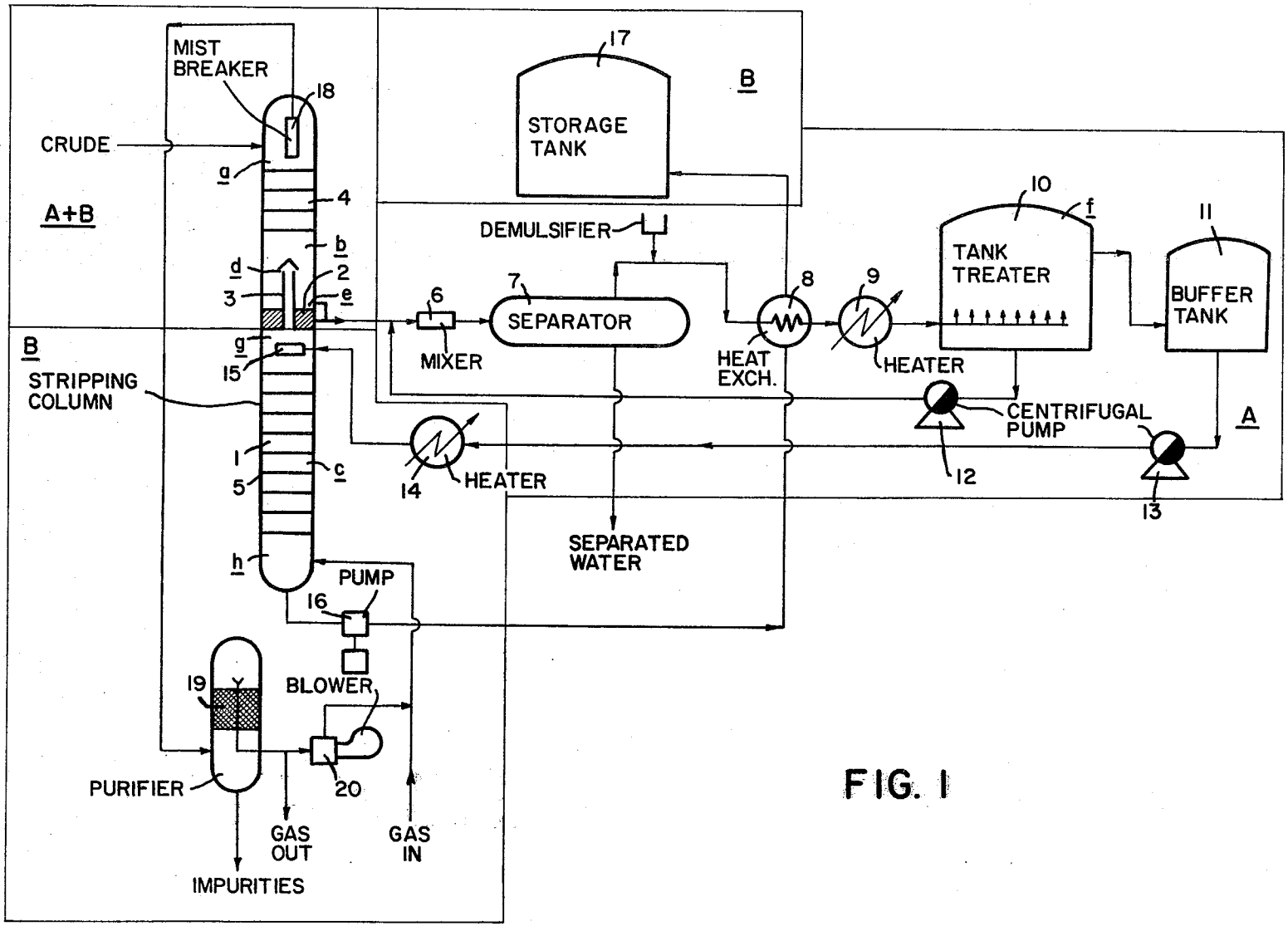
FIG. 1 a flow diagram of an apparatus for treating heavy crude oils having low salt content.
Figure 2:
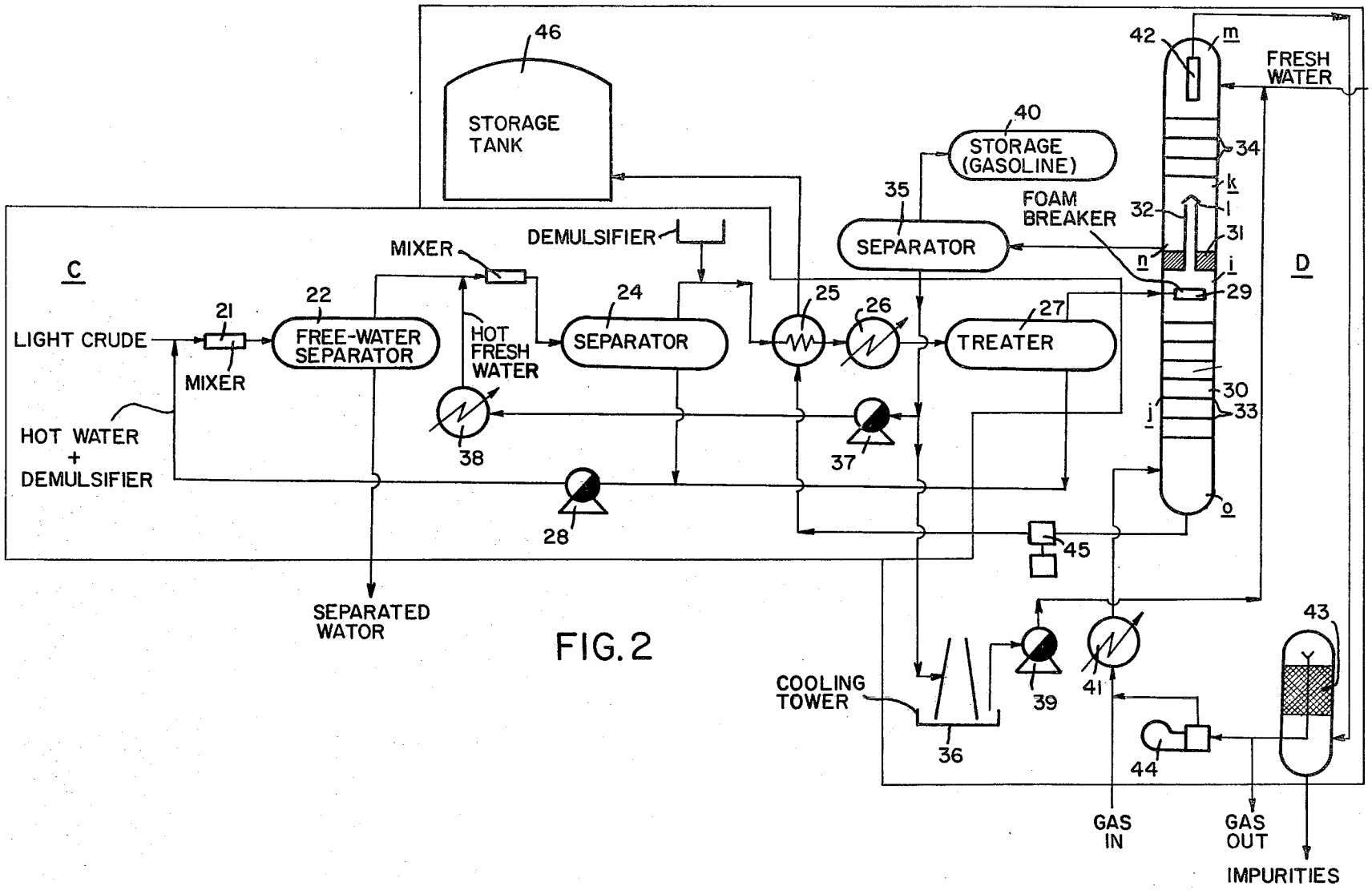
FIG. 2 a flow diagram of an apparatus for treating light crude oils having high salt content.

The process according to the invention involves crude washing with demulsifier containing hot water in several stages, depending upon the salt content of the crude. Then there follows the separation and removal of the free water and the addition of an optimum amount of demusifier whereupon the crude is directed to a treater, with or without a coalescence layer, depending upon the nature of the crude. The coalescence can also be obtained in interchangeable devices mounted up stream of the treater. The hot water separated in the treater is recirculated as a washing agent. The crude from the treater, still containing volatile fractions and/or water can be heated but in any event is at a temperature lower, equal to or higher than the stripping temperature. The crude is then introduced into the stripping column at the upper side of the lower compartment thereof where said crude contacts in countercurrent gas at a temperature lower, equal to or higher than the stripping temperature. The gas carries the water vapor and the volatile hydrocarbons to the upper compartment of the stripping column to be condensed and cooled by direct contact with a cooling fluid, such as water for light crudes or freshly fed crude or water for heavy crudes, the freshly fed crude being then washed in the described way. Finally the cool gas is led to a pipeline or recirculated within the column. The dehydrated crude is removed at the bottom of the stripping column and then used as heating agent, after which the crude is directed to a storage tank at a temperature required by the storage and transportation conditions. The above process can be used for treating crude oil/water emulsions, crudes produced by wet combustion, by micellar flooding, etc.

The unit necessary for the application of the process described in the present invention comprises; a part A for the thermochemical treatment of the crude, and a part B for stripping treatment of the crude. The cold, heavy crude is fed into the stripping column 1 through the upper end a of an upper compartment b, where the crude contacts hot, moist gas, cooling the gas, and condensing the water. The stripping column 1 is devided into two superimposed compartments b and c by a wall 2 thermally insulated by a conventional material, for example concrete. Wall 2 is penetrated by a covered tube 3, extending into compartment b; the tube 3 is provided with slots d permitting the gas circulation from compartment c to compartment b and avoiding contamination of the treated crude by the cooling fluid. The compartments b and c are equipped with trays 4 and 5 or with a filler, not shown in the drawings. The crude is removed from compartment b at the lower end c and led into part A, for thermochemical treatment.

Part A comprises a mixer 6, wherein the crude coming from compartment b contacts its own recirculated water containing a demulsifier. From mixer 6 the crude is led into separator 7, the water resulting therefrom is led away to be cleaned in cleaning means, not shown in the drawings, while an optimum amount of demulsifier is added to the crude. Said crude then passes through a hot crude heat exchanger 8, and through a heater 9, reaching a tank 10 provided or not with a coalescence layer, not shown in the drawings. The coalescence can also be obtained in interchangeable devices, mounted upstream of the treater 10. The chemically treated crude, with a water content that depends upon the salt content of the water, builds up at the top portion f of treater 10, from where it overflows into a buffer tank 11.

The hot water separated in treater 10 is introduced, by means of the centrifugal pump 12, into mixer 6, along with the crude oil removed from the compartment b of the stripping column 1.

Using pump 13, the crude is then pumped from the buffer tank 11 into the stripping part B.

In addition to column 1 and pump 13, part B comprises a heater 14 used to increase the crude temperature prior to introducing the crude into compartment c of column 1, at the top g thereof. Before contacting the trays 5 or the filling material in compartment c, the crude is passed through a foam breaker 15 consisting of wire gauze. In the compartment c the crude contacts gas that carries away the water as vapor phase. Then the crude is removed from column 1 through the bottom h of compartment c and passed, by means of pump 16, through the heat exchanger 8, being then directed to the storage tank 17. Said crude is introduced into tank 17 at a temperature required by storage and transportation conditions.

The gas used for stripping may be fuel gas or combustion gas. The use of air is not advisable, because it may cause explosive mixtures.

The gas is introduced into column 1 through the lower end h of compartment c so as to contact the hot crude. On becoming hot, the gas carries the water away as vapor phase to be condensed in compartment b. The cooled gas is removed from compartment c through the upper end a thereof and after the gas has passed through a mist breaker 18, consisting of porous material tubes, it is introduced into a purifying vessel 19. From said vessel 19 the gas may be led to a pipe-line for comsumption or it may be recirculated through column 1 using blower 20.

In another possible embodiment the unit according to the invention consists of a part C for thermochemical treatment of the crude, and a part D for stripping treatment of said crude. The light crude having a high salt content is fed into part C for thermochemical treatment, into a mixer 21, where said light crude contacts hot water having low salinity and containing a demulsifier, whence said crude oil passes into a free water separator 22, with the water being removed therefrom into purifying means, not shown in the drawings, while the crude passes into another mixer 23, where it contacts hot fresh water. From mixer 23 the crude passes into separator 24, where the free water is removed and the crude, after receiving an optimum amount of demulsifier, is passed through the heat exchanger 25 containing hot crude, and through heater 26, reaching a treater 27, with or without coalescence layer, depending upon the crude nature, not shown in the drawings. The coalescence can also be obtained in interchangeable devices mounted upstream of the treater 27. The hot water removed from separator 24 and from treater 27 is introduced into mixer 21 using the centrifugal pump 28. The crude removed from the treater 27 enters the stripping part D, passing across a foam breaker 29 mounted at the top i of a lower compartment j of the stripping column 30. In said column 30 the crude contacts in counter current hot gas, that carries the water and volatile hydrocarbons as vapor phase to an upper compartment k of column 30, where said vapor phase is condensed by direct contact with a cooling fluid, for example water. The compartments j and k are separated by a wall 31, thermally insulated with concrete and penetrated by a covered tube 32, with lateral slots 1 assuring gas circulation between compartments j and k and avoiding at the same time comtamination of the treated crude with the cooling fluid. In compartments j and k there are mounted the trays 33 and 34 or filling material, not shown in the drawings.

The cooling fluid is introduced into compartment k at the upper end m thereof, and the condensate is removed at the other end n into a separator 35, in which the water is separated from the natural gasoline. From separator 35 a portion of the water is removed into a cooling tower 36 and the other portion, using a pump 37, is pumped into a mixer 23, after passing through a heater 38.

The water cooled in tower 36 is introduced into compartment k at the end m thereof, for cooling the water vapors and volatile hydrocarbons, using pump 39. The natural gasoline obtained in separator 35 is led into the storage tank 40.

The gas used for stripping is passed through a heater 41 to be introduced through the bottom o of the compartment j into column 30, the gas being then removed at the end m of compartment k, after having passed through the mist breaker 42 consisting of porous material. From column 30 the gas is directed to a purifying vessel 43, from which it can be recirculated through column 30 using a blower 44, or can be led to a pipe-line for consumption or can be led to the processing plant, not shown in the drawings.

The dehydrated and stabilized crude oil is removed at the end c of compartment j of column 30 and, using a pump 45, the crude is led into tank 46 after giving up part of its heat into the heat exchanger 25.

The crude resulting from part C for thermochemical treatment, that still contains volatile fractions and/or water can be heated or not to a temperature lower, equal to or higher than the stripping temperature, while the stripping gas can be heated or not to a temperature higher, equal to or lower than the stripping temperature.

The advantages of the process and unit according to the present invention are as follows:

crude oil emulsions, resulting for example from producing hydrocarbons by wet combustion, can be successfully treated;

total removal of water and the substantial reduction of the salt content of the crude is ensured;

in treating crudes having a relatively high light fractions content, the effective recovery of these light fractions is possible;

thermal energy consumption is held within reasonable limits.

We claim:

1. A process for desalting and dehydrating a crude oil, comprising the steps of:

(a) washing crude oil obtained from the upper compartment of a stripping column, as hereinafter delineated, with hot water containing a demulsifier thereby producing a mixture of the crude oil and the hot water containing said demulsifier;

(b) separating free water from the mixture produced in step (a) to thereby leave a washed crude oil;

(c) adding to said washed crude oil from step (b) an optimum quantity of a demulsifier and thereafter heating the washed crude oil containing the demulsifier;

(d) settling the heated washed crude oil containing demulsifier and water and separating said water therefrom to leave a treated crude oil and produce water containing demulsifier;

(e) recirculating the water-containing demulsifier from step (d) to step (a);

(f) stripping the treated crude oil of step (d) with a gas to remove volatile hydrocarbons and water in vapor phase from said treated crude oil in countercurrent contact with said gas in a lower portion of a stripping column, thereby recovering crude oil which is stored;

(g) passing the stripping gas containing volatile components and water vapor from the lower portion of said column through an upper compartment of said column to condense the volatile components and the water vapor in said gas by contacting said stripping gas with crude oil prior to passing said oil to washing step (a);

(h) recovering cold stripping gas from step (g); and (i) recirculating to step (f) at least a portion of the recovered cold stripping gas of step (h) to said lower portion of said column.

2. The process defined in claim 1 wherein a portion of the gas recovered in step (h) is purified and transmitted to a pipeline for consumption.

* * * * *